United States Patent [19]

Fraige

[11] Patent Number: 4,602,396

[45] Date of Patent: Jul. 29, 1986

[54] WATERBED FLOTATION SYSTEM WITH VAPOR BARRIER

[76] Inventor: Richard Fraige, P.O. Box 649, Carson City, Nev. 89702

[21] Appl. No.: 650,117

[22] Filed: Sep. 13, 1984

[51] Int. Cl.[4] ..... A47C 27/08

[52] U.S. Cl. ..... 5/451; 5/470; 52/309.4; 52/410; 428/71; 428/76; 428/316.6; 428/314.4

[58] Field of Search ..... 5/451, 452, 450, 449, 5/422, 482, 500, 502, 481, 470; 297/DIG. 1; 52/410, 309.9, 309.4; 428/71, 76, 316.6, 314.4, 314.8

[56] References Cited

U.S. PATENT DOCUMENTS

| | | | |
|---|---|---|---|
| 3,763,614 | 10/1973 | Hyde et al. | 52/309.9 |
| 4,015,299 | 4/1977 | Tinnel | 5/451 |
| 4,019,296 | 4/1977 | Jochmann | 52/410 |
| 4,062,077 | 12/1977 | Autrey et al. | 5/451 |
| 4,187,566 | 2/1980 | Peterson | 5/451 |
| 4,187,567 | 2/1980 | Crowther | 5/451 |
| 4,192,031 | 3/1980 | Fogel | 5/451 |

OTHER PUBLICATIONS

"Watercloud"—The Call to Dream-a trade pamphlet available from Watercloud Bed Co. Inc., 3430 West Carriage Drive, Santa Anna, Calif. 92704, (3/79).

"Therma-Save" p. 33 of the Jan. 1984 issue of Waterbed Magazine.

"Handbook of Foamed Plastics" by *Bender*, pp. 10, 11, Lake Publishing Co., Libertyville, Ill. 1965.

*Primary Examiner*—Alexander Grosz

*Attorney, Agent, or Firm*—Poms, Smith, Lande & Rose

[57] ABSTRACT

A flotation sleep system for a liquid filled bed wherein a sheet of closed cell polyethylene foam bonded to a foamed layer is provided between the ticking of the bed and the watermattress. This arrangement prevents the collection of moisture or condensation on the watermattress and prevents the growth of mildew thereon.

3 Claims, 4 Drawing Figures

WATERBED FLOTATION SYSTEM WITH VAPOR BARRIER

BACKGROUND OF THE INVENTION

1. Field of the Invention

The invention relates to liquid-filled bedding products commonly known as waterbeds or flotation sleep systems; and, more particularly, to a flotational sleep system which prevents both the collection of moinsture or condensation on the watermattress of the bed and mildew growth, and eliminates the coldness felt when proper insulation (R-Factor) is not met.

2. Description of the Prior Art

Although waterbeds continue in popularity, there has been a trend in recent years toward some flotation sleep system designs which have the advantages of waterbeds without disadvantages of high heating costs, non-conventional look, need for special lines and blankets, etc. Flotation sleep systems have a certain nomenclature in the art. For example, the State of California defines a flotation sleep system as a liquid-filled bedding product consisting of a conventional ticking cover, a soft-sided frame intended to contain a water mattress, a water mattress, and a water mattress liner provided to capture and contain the liquid in the supporting structure should rupture occur to the water mattress. The system also includes a heater, as defined in Section 1350(e) of the California applicable Code, or, in lieu of a heater, insulation with a minimum "R" value 3.0 when tested in accordance with American Society for Testing and Materials Designation C-518-76 "Thermal Conductivity of Materials by Means of the Heat Flow Meter". Some flotation sleep systems have controlled head-to-foot and side-to-side movement, are lighter in weight using less water, adapt to existing bedroom furniture and use conventional linen and some do not require heaters. However, in prior art flotation systems, collection of moisture on the cool water mattress of the waterbed remains a problem as does the cool feel when marginal insulatin is used and the growth of mildew. Also, although some conventional flotatin systems do not require heaters, such systems might develop condensation and mildew if there is a drastic change in room temperature, as by turning up the heat. There is a need for a flotation sleep system which retains the advantages of conventional flotation systems but has improved insulation and prevents condensation and mildewing regardless of changes in room temperature within reasonable limits (40° F.–90° F. range).

SUMMARY OF THE INVENTION

It is an object of this invention to provide an improved flotation sleep system also known as a hybrid waterbed.

It is a further object of this invention to provide a flotation sleep system having improved insulating characteristics.

It is still another object of this invention to provide a flotation sleep system that includes sheets of polyethylene joined, sewn or bonded to a foamed layer between the mattress cover and the water mattress to prevent mildew and condensation.

These and other objects are preferably accomplished by providing a flotation sleep system wherein a sheet of closed cell polyethylene foam is provided between the ticking of the bed and the watermattress. This arrangement prevents the collection of moisture or condensation on the watermattress and prevents the growth of mildew.

DESCRIPTION OF THE PREFERRED EMBODIMENTS

Figure 1:
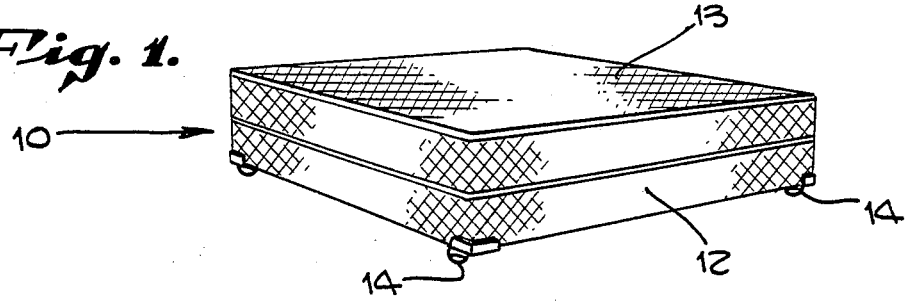
FIG. 1 is a perspective view of a flotation sleep system in accordance with the invention.

Referring now to FIG. 1 of the drawing, a waterbed flotation sleep system 10 in accordance with the invention is shown including a watermattress 11, such as a vinyl bag, a foam basin 15 (see FIG. 2), such as high density open cell polyurethane foam covered by a safety liner 16, a bottom box foundation 12 (a pair of such foundations may be provided depending on the size of the bed) and a wheeled or stationary metal rail supporting frame 14. A mattress cover 13 encloses the watermattress 11 as will be discussed.

Figure 2:
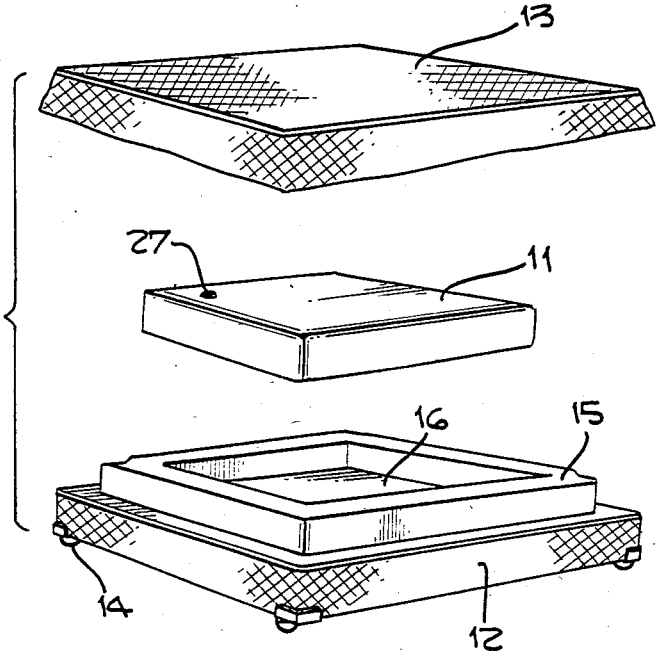
FIG. 2 is an exploded view of the system of FIG. 1.
Figure 3:
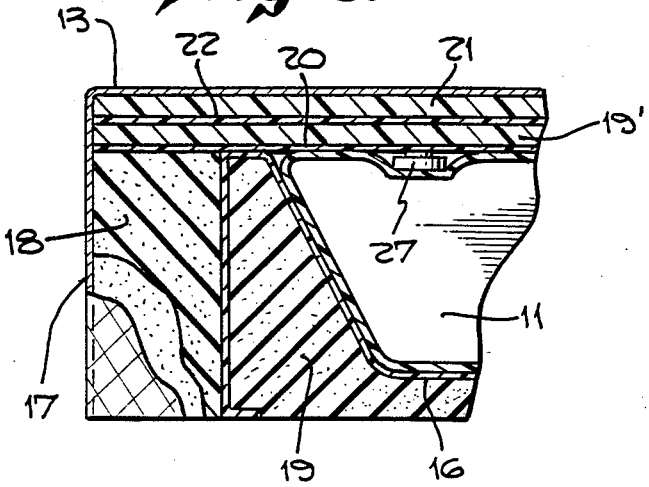
FIG. 3 is an assembled vertical view of some of the components of the system of FIGS. 1 and 2, cutaway for purposes of illustration.

As seen in FIG. 2, the foam basin 15 sets on top of a box-like foundation 12 which is mounted on the supporting frame 14 (only the wheels being visible). Watermattress 11 is then placed inside the foam basin 15 over the bottom liner 16 interiorly of the basin 15, with filler valve 27 up (FIG. 3). After filling watermattress 11 with water, and quilted mattress cover 13 is placed over the watermattress 11 and basin 15 as shown in FIG. 2.

The foregoing shows the environment of the invention and, except where otherwise indicated, forms no particular part of the invention.

Turning now to FIG. 3, the cover 13, watermattress 11, basin 15 and the inventive features of the invention are shown in detail. Cover 13 is preferably of conventional quilted fabric material, referred to as ticking, and has a downwardly depending peripheral skirt 17 (see also FIG. 1) encompassing the sides of basin 15 with side railings 18 attached to skirt 17. Basin 15 includes inner foam wedges 19, as shown. The watermattress 11 is disposed within basin 15 on top of safety liner 16 and, again, such arrangement forms no particular part of the invention other than in the invention environment claimed.

Figure 4:
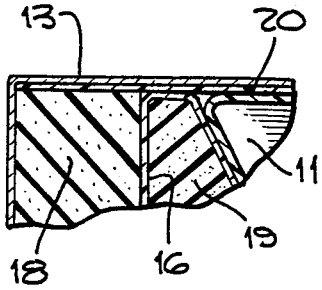
FIG. 4 is a detailed view of another embodiment of the invention.

As seen in FIG. 3, and as particularly contemplated in the present invention, condensation and mildew prevention means are provided for preventing the collection of moisture or condensation on the watermattress 11. Such means includes a sheet 20 of closed cell polyethylene foam disposed between the ticking 13 and the upper surface of watermattress 11. This sheet may be the sole sheet between ticking 13 and watermattress 11, as seen in FIG. 4, and, if the sole sheet, may be about $\frac{1}{8}$" thick.

However, if desired, as seen in FIG. 3, a plastic sheet 19', such as a sheet of open celled polyurethane foam, may be provided between sheet 20 and ticking 13. A similar sheet 21 of plastic, again such as open celled polyurethane foam, may be provided between ticking 13 and sheet 19'. Finally, a sheet 22 of a plastic material, such as closed cell polyurethane foam, may be provided between sheets 21 and 19'.

If the arrangement of sheets 19' and 20 to 22 as seen in FIG. 3 is used, sheets 20 and 22 may be about 1/32 to $\frac{1}{8}$ inches in thickness and sheets 19 and 21 may be about $\frac{1}{2}$ to $1\frac{1}{2}$ inches in thickness.

These sheets 19' and 20 to 21 may be merely disposed below ticking 13 or sewed thereto as by quilting. Preferably, however, an adhesive is provided between ticking 13 and sheet 21; between sheets 21 and 22; between sheets 22 and 19'; and between sheets 19' and 20. In the embodiment shown in FIG. 4, an adhesive or sewing, as by quilting, may be provided between ticking 13 and sheet 20. State of the art adhesive may be used.

The arrangements of layers 13 and 20 on watermattress 11 of FIG. 4, and the arrangement of layers 13 and 19' through 20 in FIG. 3, form a laminate which eliminates mildewing and the formation of water condensation on watermattress 11. It prevents the collection of moisture, condensation and mildewing on the watermattress.

As heretofore mentioned, polyethylene is preferably used for sheet 20 since it is an inert substance which does not interact chemically with PVC vinyl and polyurethanes.

The arrangement of FIGS. 3 and 4 do not require a heating device. In certain states, such as California, unheated flotation systems must conform to a certain rating, such as R-3 in California. The arrangement disclosed herein results in a system that is rated better than R-3.

The system of the invention adapts to wide changes of room temperature. For example, if the room temperature was 55° F., and one turned the room thermostat up to 75° F., the sudden change in temperature would cause condensation to form on the watermattress and, later, possible mildewing. Even in conventional unheated flotation systems, such sudden changes in temperature (using the room thermostat, for example) could cause condensation and subsequent mildewing. If a down comforter is used, moisture collection can also occur. However, in the improved system disclosed herein, no condensation on the surface of the watermattress or mildewing takes place.

The flotation system discloses herein can be adapted to a conventional waterbed installation and can be used with a headboard and/or footboard. It can be seen that we have disclosed a flotation system that has all the advantages of conventional flotation systems without the disadvantages of water condensation forming on the watermattress, mildewing, or sleeper discomfort when inadequate insulation is used. Although preferred materials and dimensions have been set forth herein, obviously any suitable dimensions may be used and any known suitable materials, such as damask, vinyl, polyethelenes, polyurethanes (foam or film), etc. except as otherwise stated may also be used.

The invention disclosed herein stops condensation and moisture on the cooler watermattress surface and the increased R factor stops the sensation of cold to a sleeper, eliminates mildew potential on the watermattress or adjacent surfaces and presents a chemical barrier. The layer materials are selected to prevent chemical interaction.

I claim:

1. In a liquid filled flotation system including a frame receiving a watermattress therein, and a covering over the watermattress, the invention which comprises:

condensation and mildew preventing means comprising a first layer of closed cell polyethylene foam disposed between the covering and watermattress providing a vapor barrier adapted to prevent water vapor from penetrating down from said cover to the upper surface of said watermattress and condensing thereon, a second layer of closed cell polyurethane foam between said covering and said first layer, a layer of plastic material disposed between said covering and said second layer and a layer of plastic material disposed between said second layer, and said first layer wherein said covering is bonded to said first mentioned layer of plastic material, said first mentioned layer of plastic material is bonded to said second layer and said second mentioned layer of plastic material is bonded to both said second layer and to said first layer.

2. The system of claim 1 wherein said first layer is about $\frac{1}{8}$" thick.

3. The system of claim 1 wherein said plastic materials are open celled polyurethane foams.

* * * * *